US008590941B2

(12) United States Patent
Schulze-Hagenest et al.

(10) Patent No.: US 8,590,941 B2
(45) Date of Patent: Nov. 26, 2013

(54) METHOD FOR PROVIDING PRINTS WITH FLUORESCENT EFFECTS AND THE PRINT ITEM

(75) Inventors: Detlef Schulze-Hagenest, Molfsee (DE); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 737 days.

(21) Appl. No.: 12/293,568

(22) PCT Filed: Mar. 14, 2007

(86) PCT No.: PCT/EP2007/002238

§ 371 (c)(1),
(2), (4) Date: Dec. 7, 2009

(87) PCT Pub. No.: WO2007/107272

PCT Pub. Date: Sep. 27, 2007

(65) Prior Publication Data

US 2010/0164218 A1 Jul. 1, 2010

(30) Foreign Application Priority Data

Mar. 21, 2006 (EP) ..... 06005704

(51) Int. Cl.
*B42D 15/00* (2006.01)
*B42D 15/10* (2006.01)

(52) U.S. Cl.
USPC ..... 283/92; 283/70; 283/72; 283/83; 283/85; 283/91; 283/94; 283/95; 283/96; 283/98; 283/114; 283/901

(58) Field of Classification Search
USPC ..... 283/70, 72, 82, 83, 85, 91, 92, 94, 95, 283/96, 98, 107, 109, 110, 114, 901
See application file for complete search history.

(56) References Cited

U.S. PATENT DOCUMENTS

| | | | | |
|---|---|---|---|---|
| 3,713,861 | A | 1/1973 | Sharp | |
| 3,793,048 | A * | 2/1974 | Nagashima et al. | 430/118.6 |
| 4,739,377 | A * | 4/1988 | Allen | 355/133 |
| 6,664,017 | B1 | 12/2003 | Patel et al. | |
| 2005/0058466 | A1 * | 3/2005 | Toyohara | 399/45 |
| 2006/0011730 | A1 * | 1/2006 | Bi et al. | 235/487 |

FOREIGN PATENT DOCUMENTS

| | | |
|---|---|---|
| JP | 10-107970 | 4/1998 |
| JP | 2002/082582 | 3/2002 |
| JP | 2004-348539 | 12/2004 |
| WO | 2005/076086 | 8/2005 |

* cited by examiner

*Primary Examiner* — Dana Ross
*Assistant Examiner* — Justin V Lewis
(74) *Attorney, Agent, or Firm* — Andrew J. Anderson; Raymond L. Owens

(57) ABSTRACT

The invention describes a method providing prints with fluorescent effects on a document generated by color electrophotographic print processes, employing an electrophotographic printer equipped with five print modules, where four printing stations are equipped with black, yellow, magenta and cyan toners and a fifth station is equipped with substantially clear fluorescent toners to be printed on top of the color toners or directly on a substrate of the print document. In further developments of the present invention, the clear fluorescent toner absorbs light in the UV-A range or comprises metallic pigments or metallic effect pigments added to the clear fluorescent toner.

8 Claims, 3 Drawing Sheets

METHOD FOR PROVIDING PRINTS WITH FLUORESCENT EFFECTS AND THE PRINT ITEM

The present invention relates to a method for providing prints with fluorescent effects on a document generated by color electrophotographic print processes whereas four printing stations are equipped with black, yellow, magenta and cyan toners.

In electrophototographic color printing usually subtractive color mixing is used whereas the printing stations are equipped with cyan, magenta, yellow and black toners. Using common pigments—like SWOP—colorants (Specifications for Web Offset Publications), typically, only 50% of all Pantone colors can be reproduced by SWOP colorants. Many popular colors fall out-side the color gamut. Specifically the fluorescent colors cannot be reproduced using a CMYK-toner set. A fluorescent tone is particularly difficult to reproduce by means of such a color mixture. It has therefore already been proposed to incorporate fluorescent pigments or dyes in the toner. For instance, U.S. Pat. No. 5,105,451, issued on Apr. 14, 1992, discloses providing a color toner composition, which contains colored fluorescent dyes that glow in yellow fluorescence under UV excitation. Examples describe liquid toners with particles size of 0.4 μm-1 μm and dry toners of 15 μm. These toners are colored and the application of this technology is limited to available dyes. In addition for any fluorescent shade a specific toner has to be designed and manufactured, which is extremely time consuming and costly.

It is an object of this invention to provide a method to print fluorescent toners together with and beside the process colors.

These objectives can be achieved according to the present invention by using florescent toner in the fifth print module station of an electrophotographic printer equipped with five print modules, where four printing stations are equipped with black, yellow, magenta and cyan toners and a fifth station is equipped with substantially clear fluorescent toners that are printed on top of the color toners. The toners may contain various fluorescent dyes. The concentration of dyes varies from 0.001 to 2% and more preferably from 0.01 to 0.5%.

This method allows having fluorescent marks on the paper without significantly coloring these areas or without changing the colors of these areas. On the other hand the method allows that any color appears fluorescent on a print as well as any picture combined of different colors and uncolored areas.

The dyes maybe optionally melt-compounded or added to the toner formulation consisting of polymer resin, optional charge control agent, via a CPT (chemical prepared toner)-process. The binder can be compounded with a colorant, i.e., a dye or pigment, either in the form of a pigment flush (a is special mixture of pigment press cake and resin well-known to the art) or pigment-resin masterbatch, as well as any other desired addenda known to the art. If a developed image without modification of the original color of the pigment is desired, no colorant need to be added. Normally, however and this is the case for the first four colors, a colorant can be included and it can, in principle, be any of the materials mentioned in Colour Index, Vols. I and II, 2nd Edition (1987) or listed in the Pantone® Color Formula Guide, First Edition 2000-2001. The choice of colorants is described as well in e.g., proceedings of IS&T NIP 20: International Conference on Digital Printing Technologies, IS&T: The Society for Imaging Science and Technology, 7003 Kilworth Lane, Springfield, Va. 22151 USA ISBN: 0-89208-253-4, p. 135. Carbon black can especially be useful while other colorants can include pigment blue, pigment red, and pigment yellow. Specific colorants can include copper phthalocyanine, and pigment blue sold under the trade designation LUPRETON BLUE SE1163. The amount of colorant, if used, can vary over a wide range, e.g., from about 1 to about 25, and preferably from about 3 to about 20 weight percent of the toner component. Combinations and blends of colorants may be used as well.

The colorant may have the function of a charge control agent and vice versa.

Otherwise, the process of the present invention can conform to any well-known process for preparing dry toners wherein pigments are conventionally incorporated in a toner core, i.e., for example by compounding, classifying and/or grinding. Instead of embedding pigments in a toner core it is also possible, for example, to utilize a shell construction to wherein a pigment is applied to the surface of a toner body, especially as part of a coating, optionally alone or mixed with other ingredients, for example with polymers, waxes, or charge control agents. Illustrative references are U.S. Pat. No. 5,298,356, issued on Mar. 29, 1994 and/or U.S. Pat. No. 6,110,633, issued on Aug. 29, 2000, the disclosures of is which are hereby incorporated by reference thereto.

Finally the inventive toner maybe coated with an additional component on the surface consisting of hydrophobic fumed metal oxides like silica, aluminia, or titania in concentrations of about 0.1% to about 3%.

The toners may be alternatively produced by so-called chemical toner processes, called as well "chemically prepared toners", "polymerized toners" or "in situ toners". The toners may alternatively be produced using controlled growing instead of grinding. Chemical process to be used are, among others, suspension polymerization (e.g., DE 4202461, DE 4202462); emulsion aggregation (e.g., U.S. Pat. No. 5,604,076, issued on Feb. 18, 1997); micro-encapsulation (e.g., DE 10011299); dispersion (e.g., U.S. Publication No. 2003/0087176 A1, published on May 8, 2003); or chemical milling (e.g., proceedings of IS&T NIP 17: International Conference on Digital Printing Technologies, IS&T: The Society for Imaging Science and Technology, 7003 Kilworth Lane, Springfield, Va. 22151 USA ISBN: 0-89208-234-8, p. 345). The disclosures of al the above references are hereby incorporated by reference thereto.

In further developments of the present invention, the clear fluorescent toner absorbs light in the UV-A range and the mean particle size of the toner is 4-20 μm or preferably 4-8 μm or even more restricted 5-7 μm. The strict reduction of the particle size is found to be optimal for this application. Coarser particles produce ragged lines and dots and thus degrade copy quality. Smaller particle sizes require longer grinding times in manufacturing and tend to produce more dirt at a given charge to mass relation.

The invention can be advantageously used in watermarking and other security printing applications. Reference is made to the PCT-patent application PCT/EP 2005/013784.

Another approach involves metallic pigments or metallic effect pigments added to the clear fluorescent toner. The combination of fluorescent and metallic effects on top of colored areas like parts of a photographic picture is most attractive e.g. for advertisement purposes. In a further development of the present invention, the pigment is made platelet shaped. This is particularly advantageous for its adduction to a surface of a (larger) toner material particle. Reference is made to European patent application 05015165.3, the disclosure is incorporated herein by reference.

It is another object of the invention to provide a print item produced by use of color electrophotographic print processes that show fluorescent effects and consist of a substantially clear fluorescent toner that is printed on top of a printed image which is produced of black, yellow, magenta and cyan toners. This print item may include fluorescent toner that absorbs light in the UV-A range. Another approach provides a print item where the clear fluorescent toner has metallic pigments or metallic effect pigments within. As mentioned above the combination of fluorescent and metallic effects on top of colored areas like parts of a photographic picture is most attractive e.g. for advertisement purposes and can be used for security printing as well.

In the detailed description of the preferred embodiment of the invention presented below, reference is made to the accompanying drawings, in which.

Figure 1:
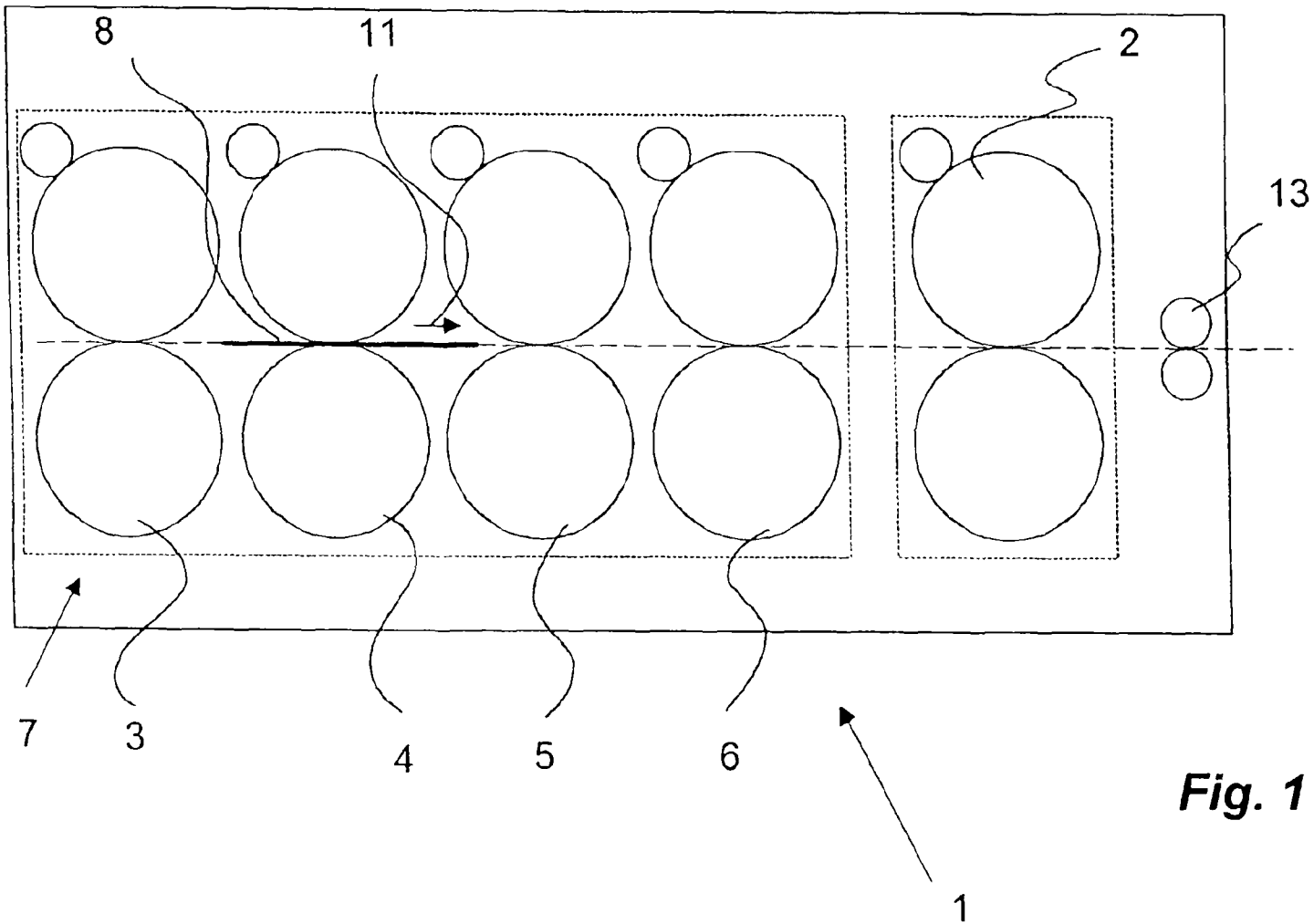
FIG. 1 shows a schematic representation of a printing machine that incorporates five printing units.

Referring now to the accompanying drawings, FIG. 1 shows a schematic representation of a printing machine 1 that incorporates a printing unit 2 for applying a colorless toner containing fluorescent dyes. The printing machine incorporates four additional printing units 3 through 6. These printing units 3 through 6 are shown collectively in FIG. 1, in a printing mechanism 7. In this printing mechanism 7, toner images in the CMYK colors are applied to substrate 8 which consists for example of paper cardboard or other packaging materials like polymeric films.

In the printing machine 1, the substrate 8, as is shown in FIG. 1, is conveyed along a travel path in the direction of the arrow 11. The substrate 8 sequentially passes through the printing mechanism 7, the printing unit 2, and a fuser mechanism 13, by which the toner images in the CMYK colors and the toner image formed by the colorless toner on top of the CMYK toner images or directly on the substrate are fused onto the substrate 8.

The toner images can be fused by the application of heat and pressure, but also by contact-free methods, for example, through continuous or discontinuous irradiation fusing, such as IR fusing, flash fusing, or microwave fusing mechanism.

The dye that is to be added to the colorless toner is selected on the basis of the composition of its wavelengths. Ideally its excitation wavelength is in the UVA range, which is contained in natural light and many forms of artificial light.

Figure 2:
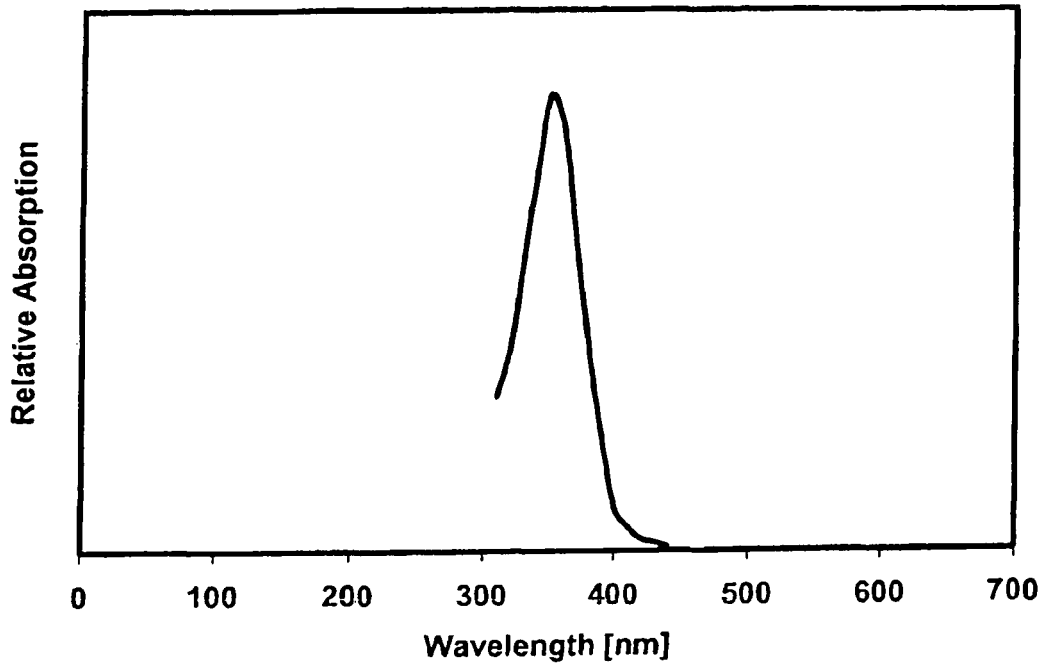
FIG. 2 shows the absorption spectra of a dye suitable to produce a substantially clear fluorescent toner and FIG. 3 shows the emission spectra of a dye suitable to produce a substantially clear fluorescent toner.
Figure 3:
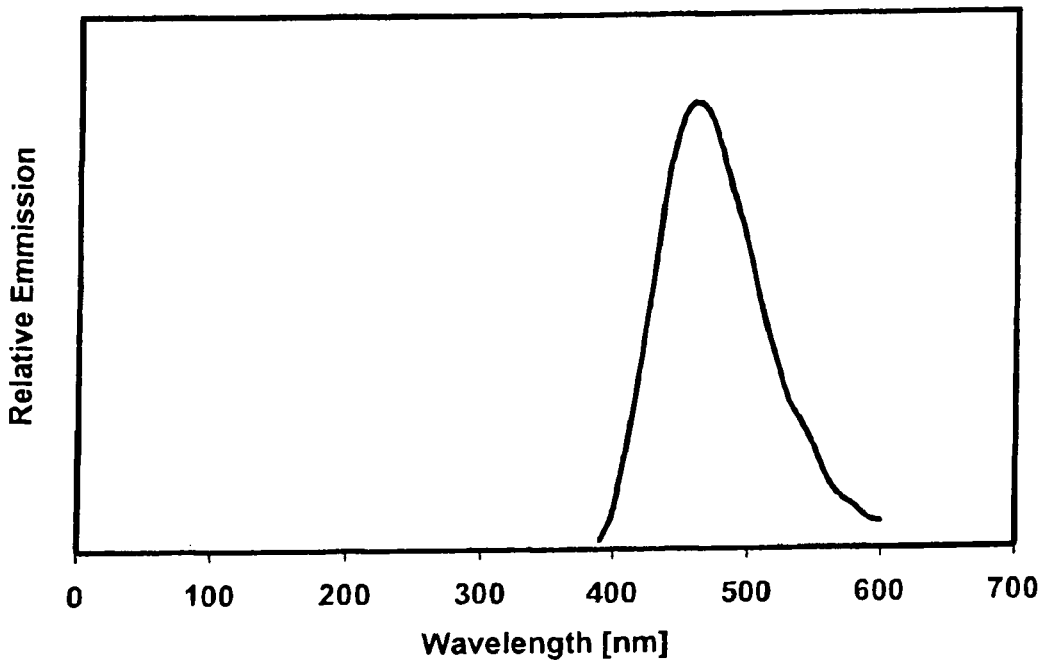
Figure 4:
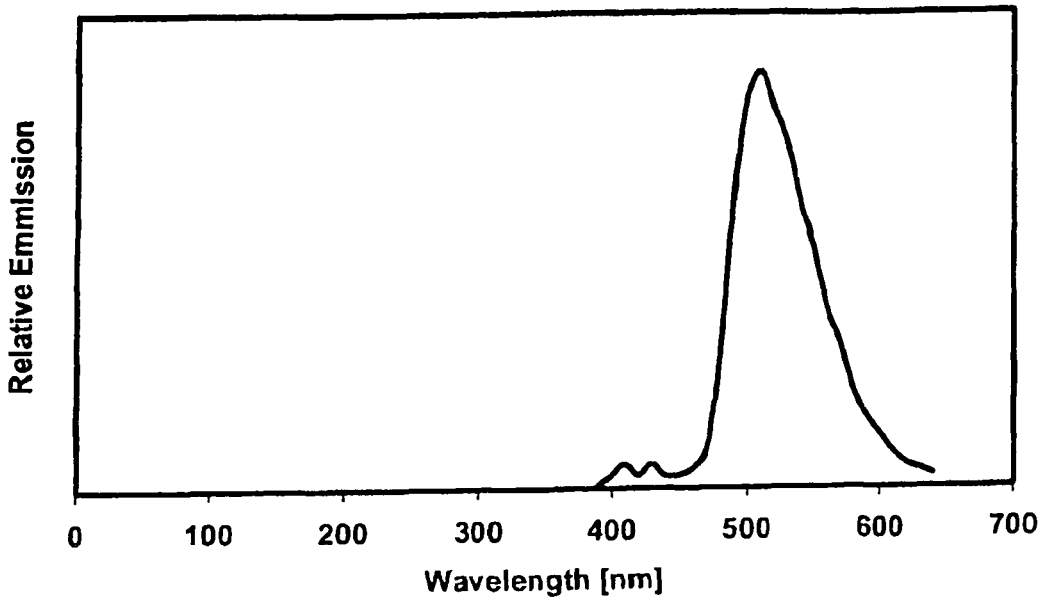
FIG. 4 shows the emission spectra of a substantially clear fluorescent toner.
Figure 5:
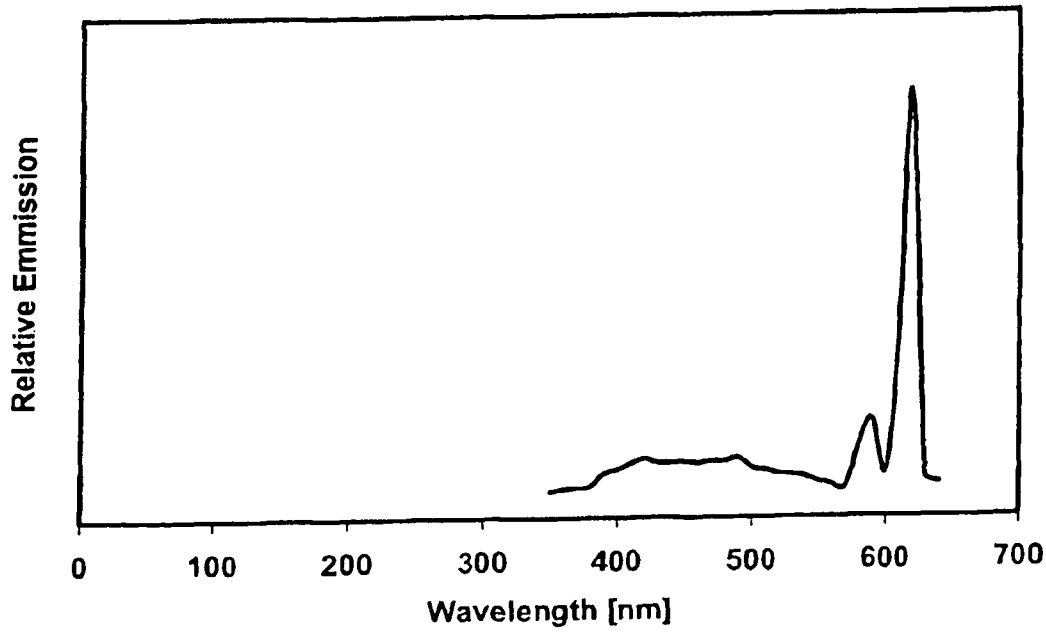
FIG. 5 shows the emission spectra of another substantially clear fluorescent toner.

FIG. 2 shows the excitation spectrum of a fluorescence dye that absorbs light in the UVA-range 325-380 nm and is added in a is concentration of 0.1% receiving a clear fluorescent toner. FIG. 3 shows the emission spectrum of the same fluorescent dye, which shows that the toner emits blue fluorescent light. FIG. 4 shows the emission spectrum of a colorless toner absorbing light in the UV-range and emitting green fluorescent light. FIG. 5 shows the emission spectrum of a colorless toner absorbing light in the UV-range and emitting red fluorescent light. Depending on the selection of the dye other fluorescent colors are achievable as well.

All these toners shown in FIG. 2-5 show excellent light fastness and tribocharging specifically for negative toners. The dyes added have no negative impact on the rheology of the toner specifically no impact on fusing or storage behavior of these toners.

The structure of red fluorescent dye used in the toner shown in FIG. 5 is

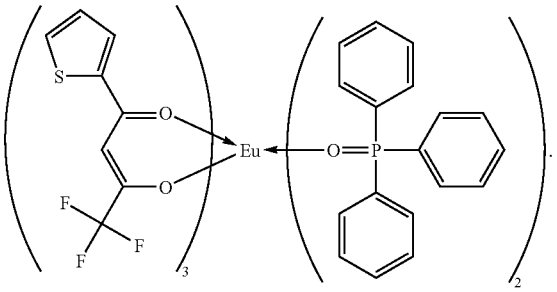

This toner has the specific advantage of having a narrow, strong and selective absorption behavior so that it is specifically advantageous for security printing applications.

The invention claimed is:

1. A method for providing prints with fluorescent effects on a document generated by a color electrophotographic printing machine having four printing stations equipped with black, yellow, magenta and cyan toners;

providing the color electrophotographic printing machine with a fifth printing station equipped with substantially clear fluorescent toner that has an emission spectrum that in response to UVA light has a peak emission between 600 and 700 nanometers, and printing such substantially clear fluorescent toner on top of the color toners or directly on a substrate of the document, wherein the clear fluorescent toner emits red fluorescent light in response to UVA light exposure and providing such clear fluorescent toner having a dye with the structure:

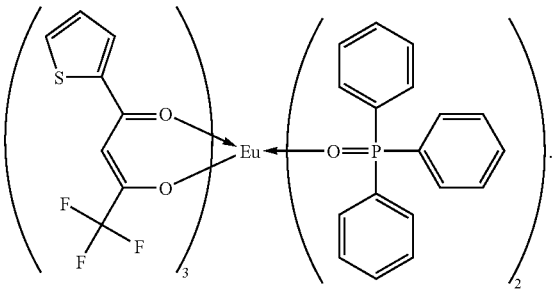

2. The method of claim 1, wherein the mean particle size of the toner is 4-20 μm.

3. The method of claim 2, wherein the mean particle size of the toner is 4-8 μm.

4. The method of claim 1, wherein the substrate of the document is sequentially passed through a printing mechanism where CMYK colors are applied to the substrate, a printing unit where the substantially clear fluorescent toner is applied, and a fusing mechanism.

5. The method of claim 1, wherein metallic pigments or metallic effect pigments are added to the clear fluorescent toner.

6. The method of claim 5, wherein the metallic pigment is plate shaped.

7. A print item produced by use of color electrophotographic print processes showing fluorescent effects, wherein a substantially clear fluorescent toner that has an emission spectrum that in response to UVA light has a peak emission between 600 and 700 nanometers, is printed on top of a printed image which is produced of black, yellow, magenta and cyan toners, wherein the clear fluorescent toner emits red fluorescent light and includes a dye with the structure:
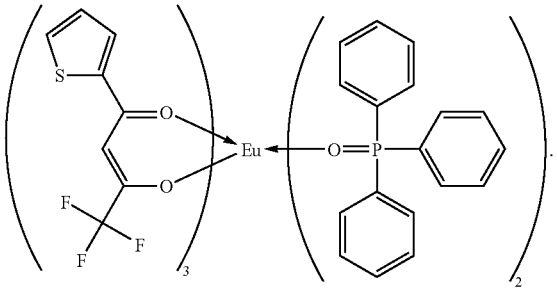
8. A print item of claim 7, wherein the clear fluorescent toner have metallic pigments or metallic effect pigments added to it.
* * * * *